United States Patent [19]

Trnka

[11] Patent Number: 4,957,155

[45] Date of Patent: Sep. 18, 1990

[54] COOLING SYSTEM FOR CONTINUOUS CASTING MACHINES

[76] Inventor: Zdenek Trnka, 5413 126th Pl. S.E., Bellevue, Wash. 98006

[21] Appl. No.: 228,614

[22] Filed: Aug. 4, 1988

[51] Int. Cl.[5] ..... B22D 15/00; B22D 11/00

[52] U.S. Cl. ..... 164/482; 164/122.1; 164/138; 164/433

[58] Field of Search ..... 164/122, 122.1, 414, 164/432, 433, 443, 444, 482, 485, 486, 138

[56] References Cited

U.S. PATENT DOCUMENTS

| | | | |
|---|---|---|---|
| 2,710,433 | 6/1955 | Properzi | 22/57.4 |
| 2,749,584 | 6/1956 | Fey et al. | 22/57.4 |
| 2,865,067 | 12/1958 | Properzi | 22/57.4 |
| 3,261,059 | 7/1966 | Properzi | 164/433 |
| 3,279,000 | 10/1966 | Cofer et al. | 22/57.4 |
| 3,318,369 | 5/1967 | Bray et al. | 164/283 |
| 3,319,700 | 5/1967 | Bray et al. | 164/283 |
| 3,322,184 | 5/1967 | Cofer et al. | 164/72 |
| 3,411,565 | 11/1968 | Properzi | 164/276 |
| 3,454,077 | 7/1969 | Cofer et al. | 164/278 |
| 3,529,658 | 7/1970 | Properzi | 164/278 |
| 3,575,231 | 4/1971 | Lenaeus | 164/433 |
| 3,626,479 | 12/1971 | Properzi | 164/154 |
| 3,642,055 | 2/1972 | Nighman | 164/87 |
| 3,774,669 | 11/1973 | Lenaeus et al. | 164/278 |
| 3,800,852 | 4/1974 | Properzi | 164/278 |
| 3,916,984 | 11/1975 | Properzi | 164/278 |
| 3,976,119 | 8/1976 | Miller | 164/268 |
| 4,069,860 | 1/1978 | Ward | 164/87 |
| 4,122,889 | 10/1978 | Richards | 164/87 |
| 4,194,553 | 3/1980 | Kimura et al. | 164/87 |
| 4,211,271 | 7/1980 | Ward | 164/433 |
| 4,287,934 | 9/1981 | Ward | 164/433 |
| 4,524,821 | 6/1985 | Berry et al. | 164/482 |
| 4,537,243 | 8/1985 | Hazelett | 164/443 |
| 4,552,200 | 11/1985 | Sinha et al. | 164/454 |
| 4,588,018 | 5/1986 | Sinha et al. | 164/413 |
| 4,588,021 | 5/1986 | Bergeron et al. | 164/432 |
| 4,749,027 | 6/1988 | Allyn | 164/485 |

FOREIGN PATENT DOCUMENTS

| | | | |
|---|---|---|---|
| 2551803 | 5/1976 | Fed. Rep. of Germany | 164/322 |
| 62141 | 5/1976 | Japan | 164/433 |
| 168751 | 10/1982 | Japan | 164/482 |

*Primary Examiner*—Richard K. Seidel
*Assistant Examiner*—Edward A. Brown
*Attorney, Agent, or Firm*—Ward Brown; Robert W. Beach

[57] ABSTRACT

The casting wheel of a continuous casting machine is cooled by a conventional external spray cooling system, but the continuous band looped around the casting wheel to close a predetermined segment of it and thereby form a continuous moving mold cavity is not directly cooled. Rather, the band incorporates a layer of heat-insulative sheet material to deter heat transfer from molten metal introduced into the mold cavity through the band. The result is that the metal solidifies in a direction generally radially outward from the casting wheel toward the insulated band. Shrinkage of the metal occurs primarily adjacent to the band so as to eliminate or reduce internal shrinkage cracks and voids.

51 Claims, 6 Drawing Sheets

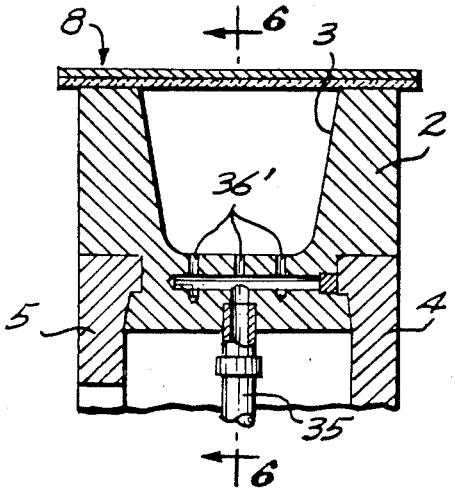
Fig. 5.
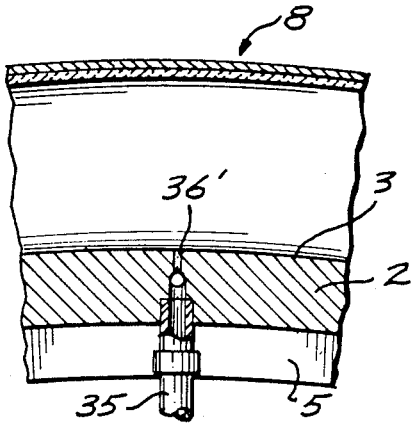
Fig. 6.
Fig. 7.
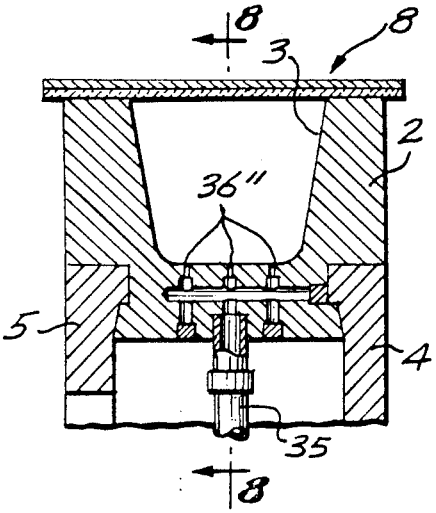
Fig. 8.
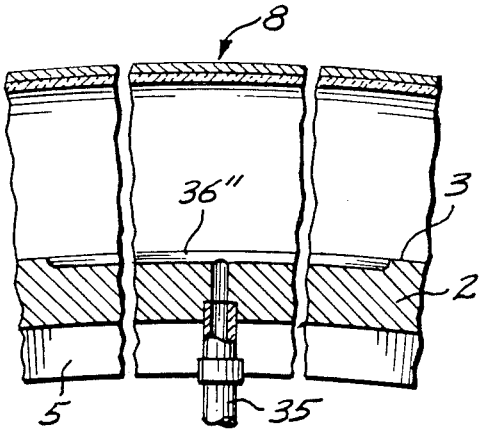

COOLING SYSTEM FOR CONTINUOUS CASTING MACHINES

BACKGROUND OF THE INVENTION

1. Field of the Invention

The present invention relates to the general field of metal founding. More specifically, the present invention relates to continuous casting machines of the type having an upright, slowly rotating casting wheel with a peripheral groove forming a mold cavity and a flexible band encircling a desired segment of the casting wheel to close the mold cavity while molten metal is solidified.

2. Prior Art

The general type of continuous metal casting machine with which the present invention is concerned is disclosed in Properzi U.S. Pat. No. 2,710,433, issued June 14, 1955. An upright casting wheel has a peripheral groove forming a continuous annular mold cavity. A continuous band or belt is looped around both the casting wheel and a large idler-tensioning pulley so as to close the mold cavity for a desired segment of its circumference. Usually, the band engages the casting wheel to close the mold cavity on its downward run and departs from the casting wheel to open the mold cavity on its upward run. Molten metal is continuously introduced into the casting wheel groove at about the location that it is first closed by the band. The metal solidifies into a continuous bar which is extracted from the groove at about the location that the band departs from the casting wheel. Thereafter, the continuous bar can be milled into rolled metal rod.

In order to obtain high-quality rod, the continuous bar leaving the casting wheel must be substantially free of internal cracks and voids. According to Properzi Pat. No. 2,710,433, > [I]t is necessary to reduce to a minimum the path of solidification, that is to say the length confined between the cross-section of the bar not yet completely solidified and the one completely liquid. This path constitutes the piece of bar in course of formation, in which the linear shrinkage of solidification may produce considerable cracks.

Column 2, lines 34 to 40. Consequently, Properzi proposed to subject the casting wheel to "vigorous cooling by means of water circulating inside the peripheral ring [casting wheel]." Column 2, lines 41 to 42.

Nevertheless, in order to increase production it is desirable to increase the speed of the wheel which inherently increases the length of the so-called "path of solidification" and which necessitates more rapid extraction of heat from the metal transported by the casting wheel. Several U.S. patents are concerned with improved cooling systems of which the following are representative:

Fey et al. No. 2,749,584, issued June 12, 1956;
Properzi No. 2,865,067, issued Dec. 23, 1958;
Bray et al. No. 3,318,369, issued May 9, 1967;
Bray et al. No. 3,319,700, issued May 16, 1967;
Properzi No. 3,411,565, issued Nov. 19, 1968;
Cofer et al. No. 3,454,077, issued July 8, 1969.

Each of the above patents discloses a casting wheel with internal cooling passages adjacent to the peripheral casting groove. In addition, in the known systems coolant such as water is sprayed onto the mold-closing band so that heat is extracted from all sides of the forming bar simultaneously.

Cofer et al. U.S. Pat. No. 3,279,000, issued Oct. 18, 1966, discloses the general type of cooling system now used, namely, closely spaced nozzles for spraying liquid coolant under high pressure against all sides of the casting wheel as well as against the band. The "Continuous Casting Wheel With Improved Cooling Arrangement" disclosed in Properzi U.S. Pat. No. 3,529,658, issued Sept. 22, 1970, also utilizes external spray cooling. That Properzi patent emphasizes that:

> Unbalanced cooling of the molten metal will result in a defective ingot structure, the ingot being subject to crystallization malformations, segregations, cracks, surface roughness and brittleness etc. and these defects being more noticeable according to increase [in size] of the ingot section.

Column 1, lines 63 to 68. According to that patent, a complicating factor is the unavoidable shrinkage of the metal during solidification which causes it to separate from the walls of the surrounding mold cavity, thereby interfering with rapid and uniform conduction of heat for extraction by the cooling sprays. Properzi in such U.S. Pat. No. 3,529,658 proposed a novel mold designed to contract as the metal solidifies so that surface contact between the cast bar and the mold would be maintained. Another, somewhat similar approach has been to apply pressure to the band to flex it inward and thereby urge the solidifying continuous bar into contact with the base of the casting wheel groove.

Since about 1970 more sophisticated efforts have been made to control cooling in continuous casting machines to achieve high production rates without unduly reducing bar quality. In U.S. Pat. No. 3,626,479, issued Dec. 7, 1971, Properzi proposed monitoring the temperature of the casting wheel at a location prior to introduction of the molten metal and adjusting the cooling of the wheel accordingly.

Nighman in U.S. Pat. No. 3,642,055, issued Feb. 15, 1972, proposed a spray-cooling arrangement but with a porous wire mesh belt such that the coolant would pass through the belt into intimate contact with the metal in the casting wheel groove.

Lenaeus et al. in U.S. Pat. No. 3,774,669, issued Nov. 27, 1973, described "zone cooling" in which different cooling rates are applied at different stages of solidification of the metal, recognizing that an air gap forms between the metal and the casting wheel during the final phases of solidification which interferes with heat conduction. During such final phase, Lenaeus et al. proposed to withdraw the mold-closing band for direct spray-cooling of the cast bar while still in the casting wheel groove.

Properzi in U.S. Pat. No. 3,800,852, issued Apr. 2, 1974, and U.S. Pat. No. 3,916,984, issued Nov. 4, 1975, also proposes "zone cooling" mechanism in which sprays at different locations along the circumference of the wheel can be adjusted independently of sprays at other locations.

Another aspect of the conventional manner of cooling the continuous cast bar is disclosed in Ward U.S. Pat. No. 4,069,860 which discusses the problem of heat transfer through the mold-closing band. High heat-transfer rate materials, such as thin metal strips, typically have lower structural strength. Consequently, the useful life of the band must be balanced against its heat-transfer rate. The suggestion of the Ward patent is to provide an "ablative material" on the inner surface of the band which material is charred or burned away due to the heat of the molten metal so as not to interfere with heat-transfer through the band.

Richards in U.S. Pat. No. 4,122,889, issued Oct. 31, 1978, proposed to increase cooling at the outer surface of the continuously cast bar adjacent to the band by injecting fluid between the band and the outer surface of the bar. According to Richards, the fluid under pressure also would produce an inward-directed force to seat the bar in the casting groove and thereby prevent formation of the air gap caused by shrinkage.

Kimura et al. U.S. Pat. No. 4,194,553, issued Mar. 25, 1980, is of interest because it recognizes the problem of internal and surface cracks in the continuous cast bar and proposes mechanism for guiding the solidified cast bar from the casting wheel. Still, according to Kimura et al., > [N]o effective countermeasure has been taken or proposed to avoid the internal cracking, because the cause of the internal cracking has not been clarified.

Column 2, lines 56 to 59.

Sinha et al. in U.S. Pat. No. 4,552,200, issued Nov. 12, 1985, and No. 4,588,018, issued May 13, 1986, propose a continuous casting system in which a "steady state" condition is established with cooling at maximum capacity. Thereafter, the speed of the casting wheel is adjusted while the location of final solidification and the porosity of the extracted cast bar are monitored in an attempt to achieve maximum production with acceptable bar quality.

Despite the considerable effort, imagination and research expenditures represented by the systems of the patents described above, the search has continued for ways to increase production and to increase bar quality—preferably both—in continuous casting machines.

SUMMARY OF THE INVENTION

The principal object of the present invention is to provide a novel cooling system for a continuous casting machine of the type described, which system allows increased production of higher-quality bar, i.e., bar essentially free of internal cracks, voids or areas of irregular porosity.

In the preferred embodiment of the present invention, the foregoing object is accomplished by providing a conventional external spray cooling system for the inner periphery and upright sides of the casting wheel but with an insulated band not subjected to external cooling, thereby promoting solidification of the metal bar in a generally radially outward direction, that is, from the base of the casting wheel groove toward the band. Internal cracks and voids are reduced or eliminated because no thick solidified shell is formed adjacent to the band before the molten metal at the center of the bar solidifies, as occurs in conventional systems in which "uniform" cooling from all directions is not only inherent but intended. In contrast, in accordance with the present invention, the cooling of the bar is nonuniform to allow the unavoidable shrinkage to occur, but in controlled directions, namely, away from the sides of the casting wheel groove and inward away from the band. Irregularities of the bar are therefore limited to the external surfaces. Such surface irregularities can be tolerated during subsequent milling.

In addition or alternatively, coolant fluid is injected through the casting wheel to fill the space between the shrinking, solidifying bar and the base and sides of the casting wheel groove and thereby increase the rate of heat extraction by convection.

BRIEF DESCRIPTION OF THE DRAWINGS

FIG. 5 is an enlarged, fragmentary, radial section of a casting wheel having a modified cooling system in accordance with the present invention; and FIG. 6 is a section along line 6—6 of FIG. 5.

FIG. 7 is an enlarged, fragmentary, radial section of a casting wheel having a further modified form of cooling system in accordance with the present invention; and FIG. 8 is a section along line 8—8 of FIG. 7.

DETAILED DESCRIPTION

Figure 1:
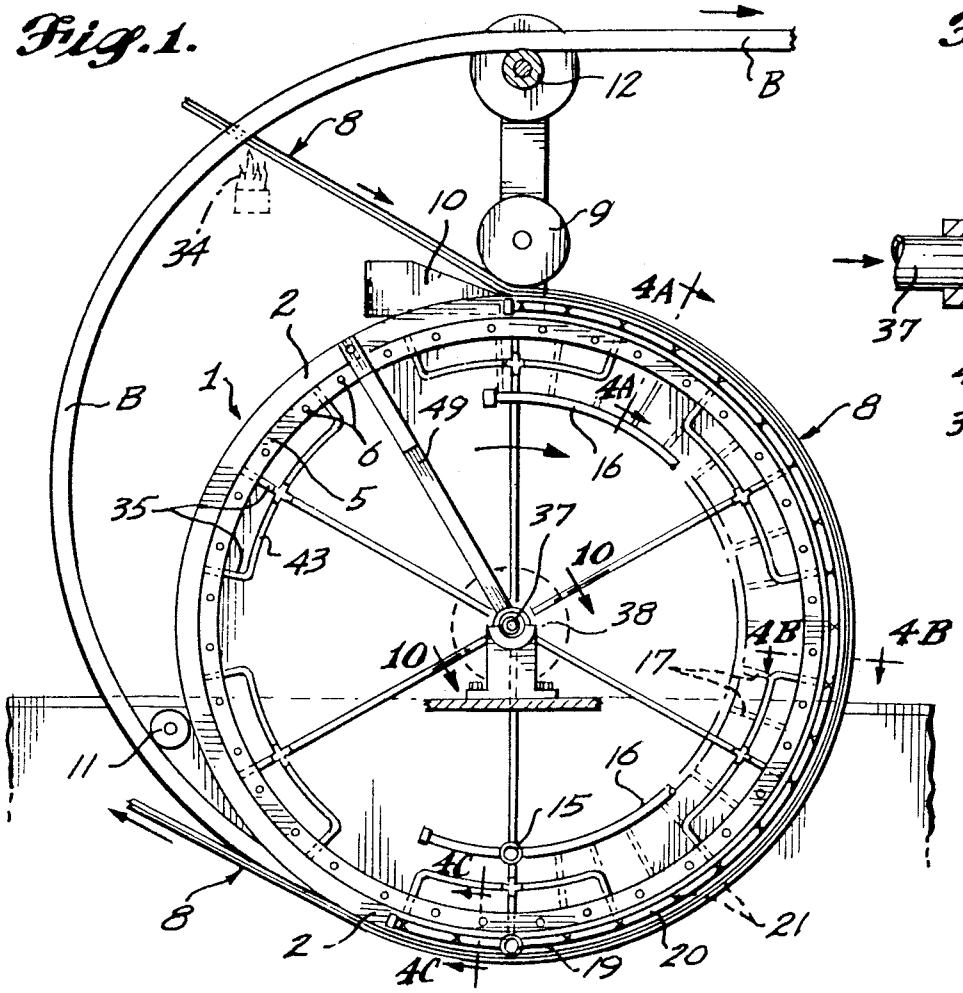
FIG. 1 is a somewhat diagrammatic side elevation of the casting wheel of a continuous casting machine having a cooling system in accordance with the present invention.
Figure 2:
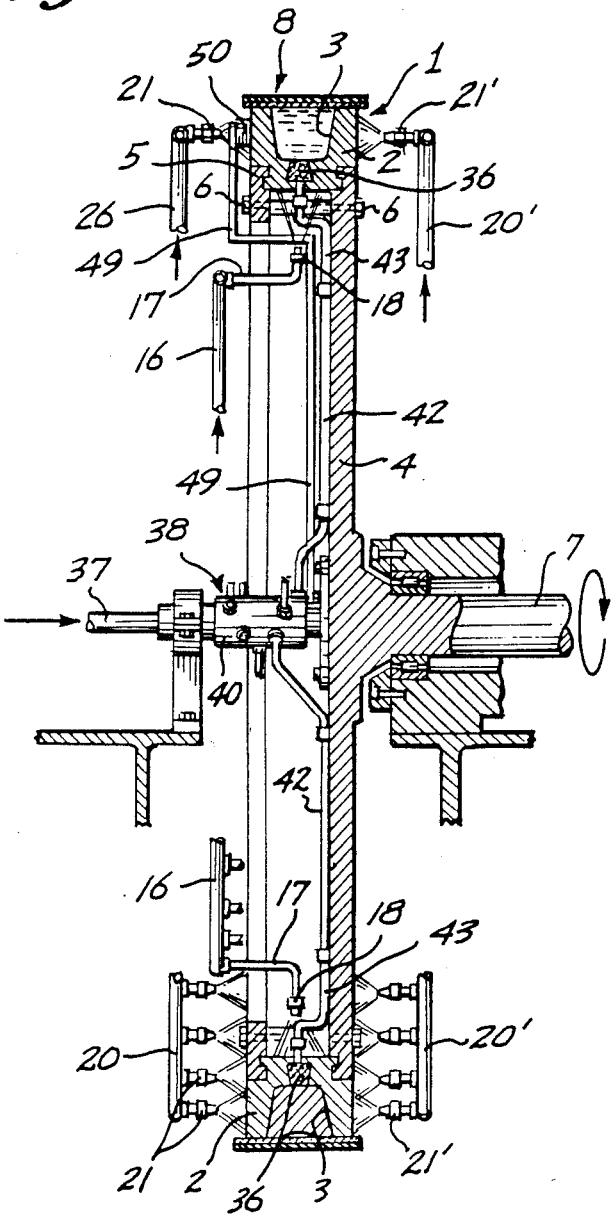
FIG. 2 is a somewhat diagrammatic end elevation of the casting wheel shown in FIG. 1, with most parts shown in section.

With reference to FIGS. 1 and 2, the present invention is intended to be used in conjunction with a continuous casting machine of the type having a first upright rotatable mold component or casting wheel 1. As best seen in FIG. 2, wheel 1 includes an outer ring mold 2 having an outward opening peripheral groove 3 forming a continuous annular mold cavity. Mold 2 is clamped between a radial inboard mounting flange 4 and a narrow outboard clamping flange ring 5 by circumferentially spaced bolts 6. The casting wheel assembly is rotated by a drive shaft 7 connected to the inboard flange 4.

With reference to FIG. 1, the upper run (first portion) of a second mold component in the form of a continuous band 8 extends from a large idler-tensioning pulley (not shown) to the upper portion of the casting wheel 1 where it is pressed against the periphery of the ring mold 2 such as by a presser roller 9. From roller 9 a segment (second portion) of the band 8 extends around the casting wheel, clockwise as shown in FIG. 1, to the lower portion of the wheel where the lower run (third portion) departs from the ring mold 2 back to another segment (fourth portion) looped around the idler-tensioning pulley.

Molten metal is introduced into the casting wheel peripheral groove by way of a spout 10 at about the location that the band 8 first engages the casting wheel which normally is close to the point where the wheel begins to move downward, i.e., approximately at the twelve o'clock position of the wheel. Band 8 closes the mold cavity from such position to the lower portion of the wheel where the band departs from the wheel. In the embodiment illustrated, the band departs from the wheel at approximately the seven o'clock position.

In the period of time that it takes the wheel to rotate approximately seven-twelfths of one revolution, the metal cast into the wheel in liquid state solidifies and is extracted conventionally in the form of a continuous cast metal bar B. Such bar curves upward and outward away from the wheel over guide rollers 11 and 12. The bar B must be angled away from the plane of the wheel in order to bypass the upper run of the continuous band 8.

To achieve a higher production rate, it is desirable to extract heat from the ring mold 2 to promote more rapid cooling and solidification of the metal into the continuous bar B. The cooling system in accordance with the present invention utilizes conventional external spray cooling for the inner periphery and opposite upright sides of the mold. As shown in FIG. 1, one supply conduit 15 for coolant such as water feeds an inner arcuate manifold 16 from which individual feeder pipes 17 lead to outwarddirected nozzles. Representative nozzles 18 at the top and bottom are seen in FIG. 2 and direct liquid coolant outward against the inner periphery of the ring mold 2 to extract heat and promote heat transfer through the base of the peripheral groove or mold cavity 3.

Returning to FIG. 1, another supply conduit 19 feeds an arcuate manifold 20 adjacent to one upright side of the casting mold 2. Manifold 20 feeds individual feeder pipes for nozzles 21 indicated diagrammatically in FIG. 1 and best seen in FIG. 2. FIG. 2 also illustrates the corresponding manifold 20' at the opposite side of the casting wheel with inward-directed nozzles 21'. Nozzles 21 and 21' spray coolant against the opposite sides of the ring mold 2 to extract heat and promote heat transfer through the sides of the mold cavity 3.

Figure 3A:
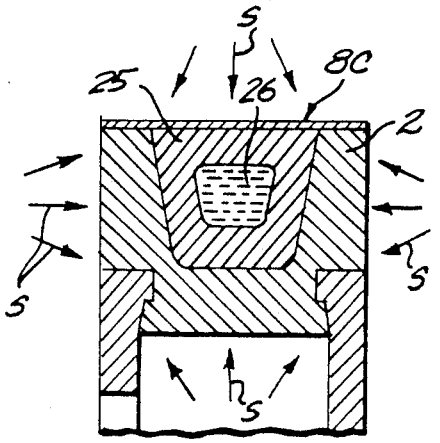
Fig. 3A (PRIOR ART)
FIGS. 3A, 3B and 3C are corresponding enlarged, fragmentary, diagrammatic sections at approximately lines 4A—4A, 4B—4B and 4C—4C of FIG. 1, respectively, illustrating solidification of molten metal in a conventional continuous casting system.
Figure 3B:
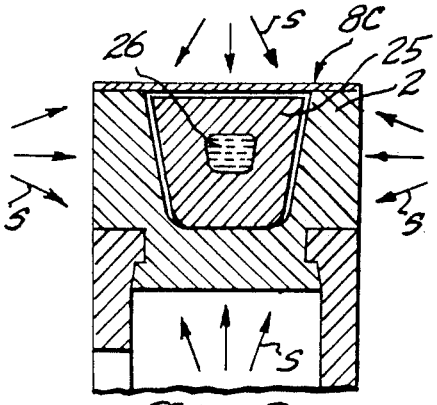
Fig. 3B. (PRIOR ART)
Figure 3C:
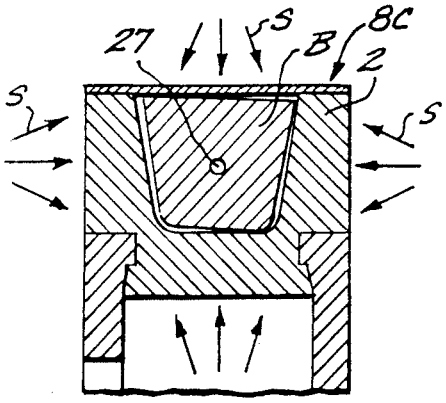
Fig. 3C. (PRIOR ART)

In a conventional spray cooling system, there is an additional outer manifold with individual spray nozzles to direct a heat-extracting spray of coolant against the mold-closing band from about its point of engagement with the casting wheel to its point of departure, in accordance with the accepted belief that it is important to cool the entire circumference of the solidifying bar uniformly. Stages of formation of the continuous bar in such a conventional system are represented in FIGS. 3A, 3B and 3C. Typically, the casting wheel mold 2 is formed of a highly heat-conductive material, such as copper or copper alloy, and the mold-closing band 8C (conventional) is a thin steel strip, thin for high heat conductivity and steel for strength and durability. Ideally, in a conventional system, the heat-extracting sprays S quickly cool the molten metal from all sides. As indicated in FIG. 3A, the initial result is to form a shell 25 of solidified metal of substantially uniform thickness circumferentially of the mold cavity with a liquid core 26. As the metal cools, the thickness of the shell 25 increases, as indicated in FIG. 3B, and the cross-sectional area of the molten core 26 decreases. Also, shrinkage of the metal bar in formation begins to occur and the sides of the bar draw away from the walls of the ring mold 2 and band 8C. The resulting gaps between the external surfaces of the bar and the composite mold greatly inhibit heat transfer and, consequently, slow down the solidification process.

The interference with heat transfer between the solidifying bar and the ring mold is aggravated in the area adjacent to extraction of the bar from the casting wheel. As mentioned above, in the type of casting machine illustrated, the bar must be angled away from the plane of the casting wheel to bypass the upper run of the band which causes the bar B to twist in the casting groove, as represented in FIG. 3C. In that area, only a few points of the periphery of the bar will be in engagement with the ring mold and the mold-closing band.

Eventually, the thickness of the outer shell 25 is great enough so as to impart sufficient structural strength that further shrinkage of the solidifying metal will not occur from the periphery of the bar inward. It is the inventor's belief that at that point a shrinkage crack or void 27 can result at the center of the bar, as represented in FIG. 3C.

The conventional "uniform" solidifying process can be envisioned as pouring molten metal into a funnel formed by the outer shell 25 of solidified metal. The thickness of the shell increases in the direction of wheel rotation and, accordingly, the cross section of the funnel containing liquid metal decreases. As the length of the funnel increases, as will inherently occur if the speed of rotation of the wheel is increased, it is increasingly unlikely that the tip or apex of the funnel will continue to be filled with molten metal without creation of voids. At some point, the pressure of the molten metal adjacent to the apex of the funnel will be insufficient to overcome the strong surface tension across a small area and a void will result. In an extreme example, a long void may be formed at almost precisely the cross-sectional center of the bar rendering it useless for formation of high-quality milled rod.

Internal cracks are formed frequently even if the speed of casting is set slow enough to prevent formation of the above-described voids. Cracks occur when the last portion of the inner core solidifies and shrinks away from the already solid, strong, previously solidified outer shell. These cracks occur frequently; some heal in subsequent milling operations and some do not.

A first improvement of the present invention is to provide a novel mold-closing band and to eliminate the direct, deliberate cooling of a substantial portion of such band, preferably the major portion of the segment of the band looped around the casting wheel, and most preferably the entire segment of the band looped around the casting wheel. In accordance with the present invention, band 8 has an outer structural layer 30 and an inner nonstructural, preferably insulative, layer 31 secured to such outer layer. The outer structural layer can be a strip of strong steel and the inner layer can, for example, be a strip of insulative ceramic fiber paper such as Fiberfrax® paper available from Standard Oil Engineered Materials Company Fibers Division of Niagara Falls, New York. The inner layer can be adhesively bonded to the outer layer or, as illustrated in FIGS. 4A, 4B and 4C, the width of the band 8 can be increased so that its opposite margins overhang the opposite sides of the ring mold 2 leaving room for mechanical connection of the inner and outer layers 30 and 31 such as by return bent spring clips 32.

Figure 4A:
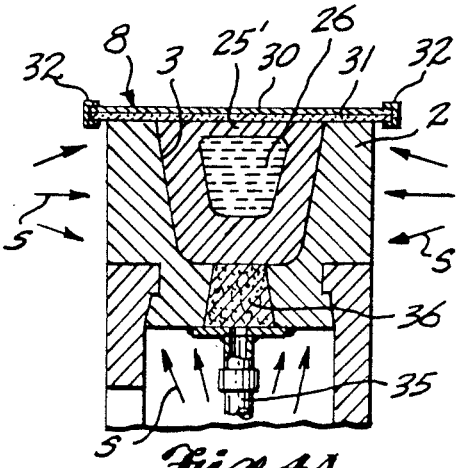
FIGS. 4A, 4B and 4C are corresponding enlarged, fragmentary, diagrammatic sections at approximately lines 4A—4A, 4B—4B and 4C—4C of FIG. 1, respectively, illustrating solidification of molten metal in a system in accordance with the present invention.
Figure 4B:
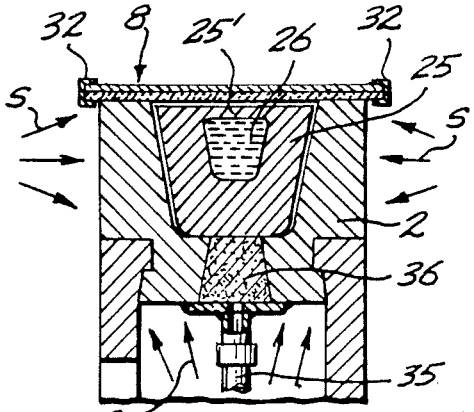
Figure 4C:
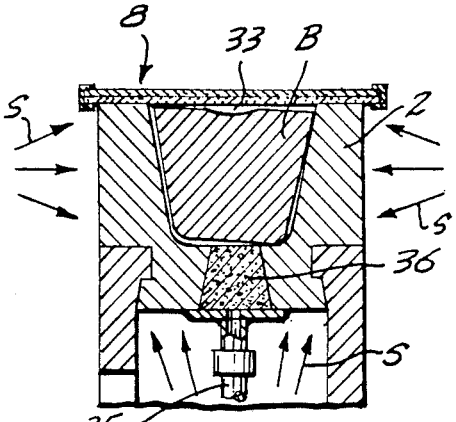

The stages of formation of the continuous bar in the improved system utilizing the composite band 8 are represented in FIGS. 4A, 4B and 4C. As described above, conventional sprays S of coolant still are directed against the inner periphery and opposite upright sides of the ring mold 2, but there is no direct cooling of the composite band 8. Consequently, the metal solidifies primarily from the base of the casting groove 3 outward toward the band 8 and from the opposite sides of the casting groove inward toward its center. Nevertheless, undoubtedly a thinner solidified shell section 25' will be formed adjacent to the band 8 because of the necessarily lower temperature of the band as it first engages the mold ring 2, as compared to the higher temperature of the molten metal introduced into the casting groove.

With reference to FIG. 4B, as the solidification process continues, the core 26 of molten metal decreases in size and its center shifts outward as the sides and base of the solidified shell 25 increase in thickness. There will still be shrinkage of the sides of the bar in formation away from the sides of the casting groove 3, and the outer shell section 25' is sufficiently thin so as to bend or flex inward to accommodate the inherent shrinkage. With reference to FIG. 4C, rather than forming an internal void or crack, a slight shrinkage depression 33 may be formed in the outer surface of the solidified bar B, but the interior of the bar will be of uniform density for forming high-quality rolled rod by conventional milling.

Providing the nonstructural insulative layer 31 at the inside of the belt has the advantage of maintaining the structural layer 30 of the belt at a cooler temperature which may increase its life. On the other hand, the inside layer is subjected to mechanical stresses from engagement against the ring mold. Consequently, it may be desirable to pay out the insulative sheet continuously from a roll adjacent to the spout 10, seen in FIG. 1, and to haul in the sheet adjacent to the location of extraction of the bar B. The sheet could be used for only one pass or could be reused a predetermined number of passes before being replaced by a fresh roll. Alternatively, the insulative layer may be provided at the outside where there would be less mechanical stress. Another possibility is to provide a sandwich construction of an insulative layer between structural layers, or a structural layer between insulative layers.

Particularly if there is a layer of insulative material such as ceramic paper at the inside of the band which will come into contact with the molten metal, a flame dryer component 34, shown diagrammatically in broken lines in FIG. 1, can be provided below the upper infeed run of the band 8. Such component drys the band to prevent moisture from coming into contact with the molten metal and also has the advantage of preheating the band to slow down solidification adjacent to it, thereby promoting the outward-directed solidification in accordance with the present invention.

Another aspect of the present invention is the provision of mechanism for increasing cooling of the solidifying bar, particularly at the base and/or sides of the casting groove. With reference to FIGS. 4A, 4B and 4C, the general concept is to supply coolant or heat transfer fluid through the casting wheel ring mold 2 directly into the groove 3, preferably through the inner periphery of the mold to flow into the base of the groove so as to promote the outward-directed solidification process. In the embodiment shown in FIGS. 4A, 4B and 4C, heat transfer fluid supply pipes 35 feed fluid through frustoconical, porous, ceramic or carbon inserts or plugs 36 inset in the base of the casting groove 3. The outer faces of the plugs are flush with the base of the casting groove, and the plugs preferably are substantially uniformly spaced circumferentially of the casting wheel. The pores of the plugs 36 are sufficiently large for flow of the heat transfer fluid therethrough and sufficiently small that surface tension of the metal even when first poured into the casting groove prevents the metal from entering the plugs. The coolant or heat transfer fluid acts primarily in the base of the casting groove but, as shrinkage occurs as indicated in FIGS. 4B and 4C, the fluid fills the gaps between the sides of the solidifying bar and the ring mold 2, thereby increasing heat transfer from the base and sides of the bar to the ring mold for extraction by the cooling sprays S. Heat extraction also occurs by convection.

The heat transfer fluid preferably is a mineral or synthetic oil such as the oil sold under the trademark "Heatshield" available from Stuart-Ironsides, Inc., of Willowbrook, Ill. Such heat transfer fluid also could be in gaseous form such as dry compressed air or a mixture of dry compressed air and oil.

In the modification shown in FIGS. 5 and 6, each heat transfer fluid supply pipe 35 communicates with small, transversely spaced holes 36' in the base of the casting groove 3 for introduction of the heat transfer fluid through such holes rather than through a porous insert or plug. In the modification shown in FIGS. 7 and 8, each heat transfer fluid supply pipe 35 communicates with narrow, circumferentially extending, transversely spaced grooves 36" for introduction of the heat transfer fluid. The sizes of the openings, i.e., the diameters of the holes 36' and the widths of the slots 36" are large enough to permit free flow of the heat transfer fluid but small enough to prevent entrance of molten metal because of its high surface tension.

Preferably, the heat transfer fluid is injected into the base of the casting groove for only a segment of its rotation. Such injection can begin shortly after the solidified shell portion in the base of the groove is formed, such as between the one and two o'clock positions of the casting wheel if casting begins at about the twelve o'clock position, and can continue to the point of extraction of the bar from the wheel. Too early an introduction of the heat transfer fluid may itself cause surface porosity, and too late an introduction of heat transfer fluid would fail to obtain maximum benefits from this system.

Figure 10:
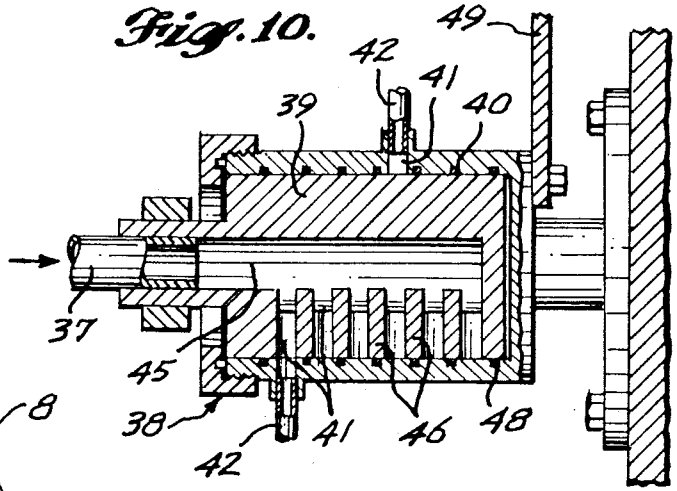
FIG. 10 is an enlarged fragmentary section along line 10—10 of FIG. 1.
Figure 9:
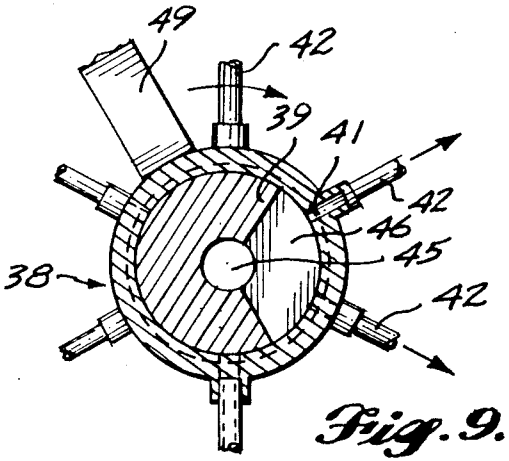
FIG. 9, on the drawing sheet with FIG. 1, is an enlarged diagrammatic side elevation of the central portion of the casting wheel shown in FIG. 1, with parts broken away.

A first form of control for the supply of the heat transfer fluid is illustrated in FIGS. 1, 2, 9 and 10. With reference to FIGS. 1, 9 and 10, the heat transfer fluid is introduced axially of the casting wheel through a supply pipe 37 leading to the interior of a multiport distributor valve 38. Valve 38 has a stationary core 39 closely fitted inside a cylindrical rotating component 40 having axially and radially spaced outlet openings 41. Each such opening 41 receives a radially projecting outlet conduit 42 which, with reference to FIG. 1, feeds an arcuate manifold 43 from which the separate feeder pipes 35 lead to the openings in the inner periphery of the ring mold 2.

The core 39 of the distributor valve has a central blind bore 45 in communication with the interior of the supply pipe 37. One side portion of the core, the left side portion as viewed in FIG. 9, is solid and blocks the passage of heat transfer fluid from the supply pipe 37 through openings 41 and outlet pipes 42 disposed toward that side. The other side of the core, the right side as viewed in FIG. 9, has openings extending outward from the bore 45 between stationary divider plates 46 formed in one unit with core 39. Such divider plates form a continuation of the solid portion of the core 39 for continuous engagement with O-rings 48 inset in the inner periphery of the rotating component 40 as seen in FIG. 10. Such O-rings prevent cross communication between the outlet openings 41.

The effect is that as component 40 rotates, each opening 41 is in communication with the central blind bore 45 of core 39 and, consequently, in communication with the heat transfer fluid supply pipe 37 only for a predetermined angle of rotation. In the illustrated embodiment, as best seen in FIG. 9, each supply pipe 42 will convey the heat transfer fluid under pressure to its manifold 43 and feeder pipes 35 from about the one or two o'clock position to about the five o'clock position. For the remainder of the rotation, the opening 41 is closed by the solid portion of the stationary core 39.

To assure synchronous rotation of the rotatable member 40 with the casting ring 2 without subjecting the supply pipes 42 to undue mechanical stress, preferably a rigid arm 49 is connected between the rotatable component 40 and the casting ring 2.

Routing of the supply pipes 42 is shown in FIG. 2. Each pipe first extends radially from the rotating component 40, is bent inward to the casting wheel mounting flange 4 and extends radially outward past the inner spray nozzles 18. At that point, the heat transfer fluid supply pipes are bent outward to approximately the center of the ring mold 2 to their manifolds and connections to the openings in the base of the casting ring groove 3. The arm 49 extends parallel to the mounting flange 4 and is bent outward around nozzles 18, then upward to its point of connection 50 to the casting wheel ring 2.

The routing of the heat transfer fluid supply conduits 42 described above is acceptable for installations where the ring mold 2 is keyed to its inboard mounting flange 4 and outboard clamping flange 5. In some installations, however, there is no such keyed connection and over a long period mold 2 may slip in the flanges 4 and 5. In that case, the routing illustrated in FIG. 2 would be unacceptable because the supply conduits 42 would soon come into contact with the clamping bolts 6.

Figure 11:
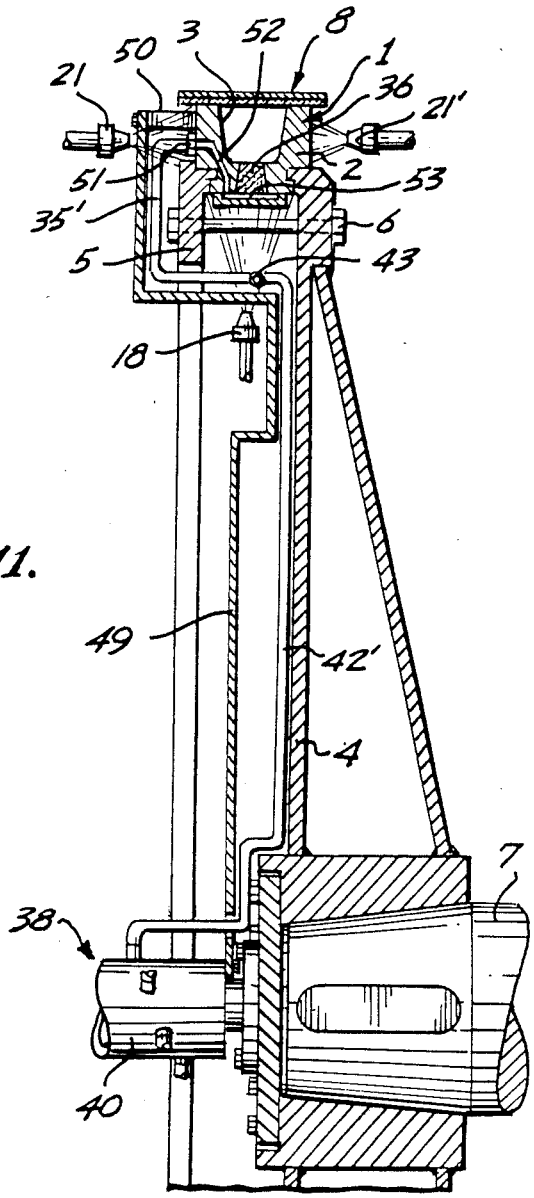
FIG. 11 is an end elevation of the upper portion of a casting wheel having another form of cooling system in accordance with the present invention, with parts broken away.

In the modified routing shown in FIG. 11, the supply conduits 42' from the rotatable distributor valve component 40 extend closely adjacent to the inboard mounting flange 4 but are not directly connected to it. Each conduit 42' is bent outward around the inner spray nozzles 18 to the corresponding arcuate manifold 43. From manifold 43, each separate feeder pipe 35' extends outward and upward around the outboard clamping flange 5, past the bolts 6 to a fitting 51 projecting from the adjacent side of the ring mold 2. The ring mold is formed with internal passages 52 extending downward and inward to channels 53 in communication with the porous ceramic or carbon plugs 36 which form the openings for heat transfer fluid into the mold cavity 3. The arm 49 assuring synchronous rotation of the distributor valve component 40 with the ring mold 2 follows the same general path. The supply conduits 42', manifolds 43, feeder pipes 35' and arm 49 do not interfere with and are not affected by slippage of the ring mold 2 relative to the mounting flange 4.

Figure 12:
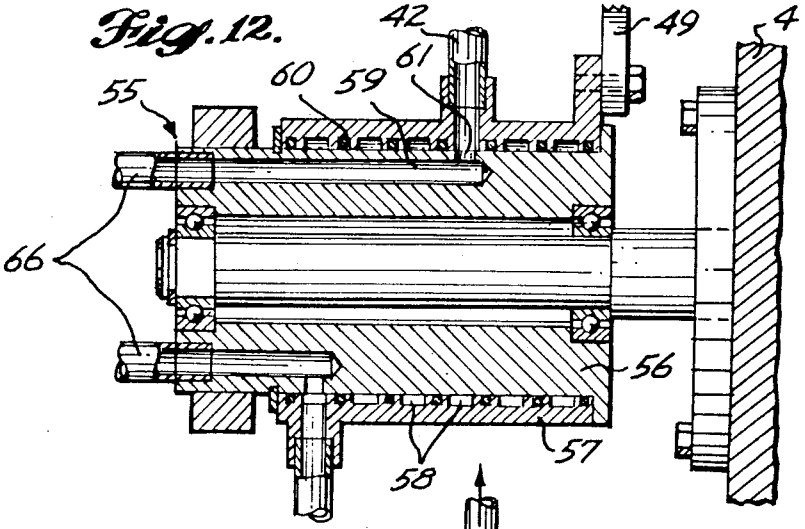
FIG. 12 is a vertical section of the central portion of a casting wheel having still another modified form of cooling system in accordance with the present invention.
Figure 13:
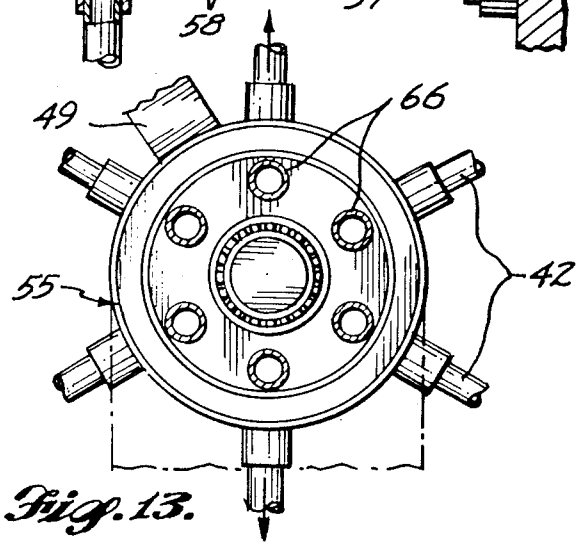
FIG. 13 is a diagrammatic side elevation of such central portion.
Figure 14:
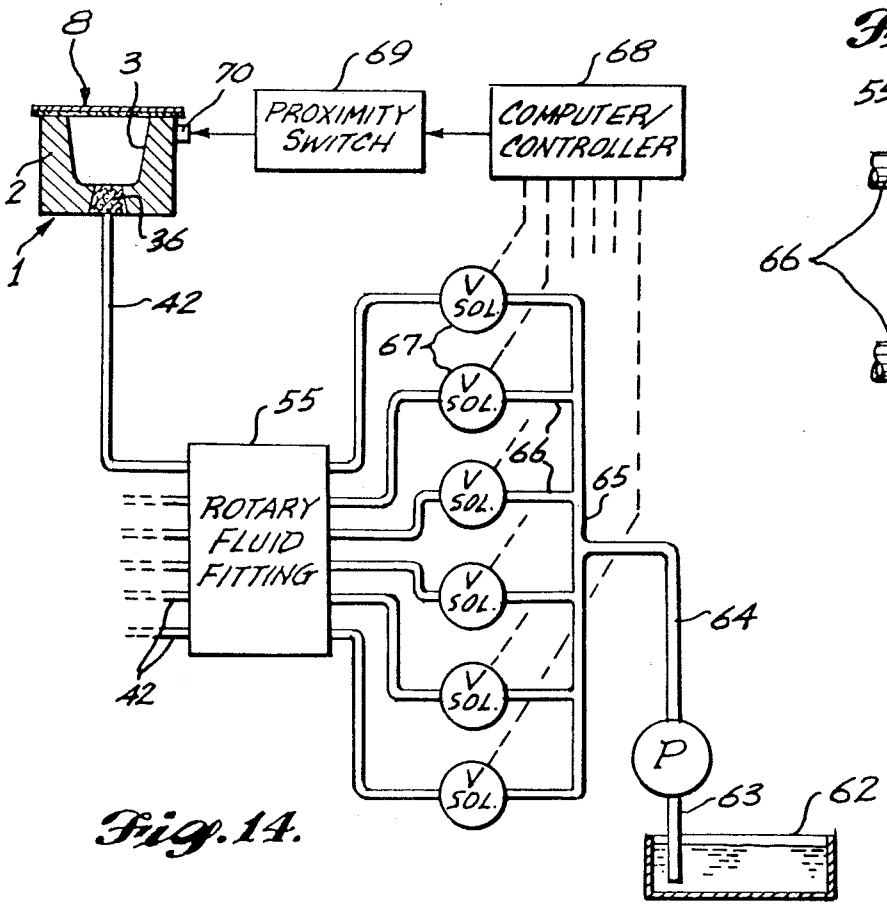
FIG. 14 is a diagrammatic representation of the control system of such cooling system.

In the modified embodiment illustrated in FIGS. 12, 13 and 14, the heat transfer fluid supply system uses a central rotary fluid fitting 55 which is not by itself directionally biased. As seen in Figure 12, such fitting has an inner stationary cylindrical core portion 56 and an outer cylindrical component 57 closely fitted on the inner portion but rotatable relative thereto. The inner periphery of the rotatable component 57 has grooves 58 forming continuous annular channels. Each such channel is in communication with a separate passage 59 extending through the inner stationary cylindrical core portion 56 to a supply line 66. Cross communication between the separate channels is prevented by O-rings 60 located between the separate grooves 58.

The rotating component 57 has circumferentially and radially spaced openings 61 from the grooves or channels 58, respectively, for the heat transfer fluid supply conduits 42. As indicated in FIG. 14, such conduits 42 lead to the openings in the base of the mold cavity 3 of the ring mold 2 such as through the porous ceramic or carbon plugs 36. Heat transfer fluid is supplied through fitting 55 to the separate conduits 42 from a common source, such as a reservoir 62. As represented in FIG. 14, a pump P draws fluid from the reservoir through an inlet line 63 and discharges it through an outlet line 64 to a manifold 65 from which a separate supply line 66 branches for each of the separate conduits 42.

Each of the individual supply lines 66 has a remote actuated valve 67 that can be controlled by a computer or programmable controller 68. Such computer or programmable controller can receive signals from sensing mechanism such as a proximity switch 69 to monitor the position of the ring mold 2 by sensing the passage of one or more indexing projections 70.

The computer/microprocessor can allow for adjustment of the supply of heat transfer fluid through the supply conduits 42 to the openings in the base of the mold cavity 3. For example, suitable programming can provide for opening the appropriate valve 67 a predetermined period of time after the indexing projection 70 passes the proximity switch 69 and for such valve to remain open a predetermined period of time. Different timing patterns may be desirable for casting of different metals or alloys, for example, and the system can be adapted to monitor other variables such as the pressure, temperature or flow rate of liquid coolant sprayed on the ring mold.

I claim:

1. In a continuous casting machine having a rotatable casting wheel with a peripheral groove forming a continuous outward-opening mold cavity, band means for closing a segment of such mold cavity, the band means including a first portion approaching the casting wheel to a point of engagement therewith, an elongated second portion extending from said first portion and looped around the casting wheel, such elongated second portion having its width extending across, overlying and closing the mold cavity, and a third portion extending from said second portion and departing from the casting wheel, means for introducing molten metal into the casting wheel peripheral groove adjacent to the point of engagement of the band means first portion with the casting wheel for solidification thereof during rotation of the casting wheel through the segment closed by the band means second portion and means for cooling the casting wheel in such segment closed by the band means second portion for extraction of heat to promote solidification of the metal, the improvement comprising means for deterring heat transfer from the metal to the band means throughout a central portion and substantially the entire width of the band means second portion which closes the mold cavity for a substantial portion of the length of the band means second portion so as to induce solidification of the metal in the area adjacent to the casting wheel cooled by the cooling means more than adjacent to such substantial portion of the length of the band means second portion, whereby the metal solidifies in a direction outward from the casting wheel toward the band means more than would occur if heat transfer were promoted uniformly around the circumference of the metal in the mold cavity.

2. In the machine defined in claim 1, the deterring means deterring heat transfer from the metal to the band means throughout the central portion and substantially the entire width of the band means second portion which overlies the mold cavity for the major portion of the length of the band means second portion.

3. In the machine defined in claim 1, the deterring means deterring heat transfer from the metal to the band means throughout the central portion and substantially the entire width of the band means second portion which overlies the mold cavity for substantially the entire length of the band means second portion.

4. In the machine defined in claim 3, the deterring means including a solid layer of heat-insulative material secured to the band means second portion and overlying the central portion and substantially the entire width of the mold cavity.

5. In the machine defined in claim 2, the cooling means including means for cooling the casting wheel in the segment closed by the band means second portion without direct cooling of the band means.

6. In the machine defined in claim 2, the band means second portion including a layer of metal material and a layer of heat-insulative sheet material secured to said layer of metal material, said layer of heat-insulative sheet material overlying the central portion and substantially the entire width of the mold cavity.

7. In the machine defined in claim 6, the layer of insulative sheet material being bonded to the layer of metal material.

8. In the machine defined in claim 6, the band means second portion including opposite margins projecting outward beyond the opposite sides of the casting wheel, and including means for mechanically connecting the opposite marginal portions of the band means layers.

9. In the machine defined in claim 6, the layer of insulative sheet material being disposed on the inside of the band means second portion for engagement against the casting wheel such that the layer of metal material is disposed opposite the casting wheel from the layer of insulative sheet material.

10. In the machine defined in claim 6, the insulative sheet material being ceramic fiber paper.

11. In the machine defined in claim 1, the casting wheel having a through passage opening into the mold cavity, and means for introducing heat transfer fluid under pressure through such passage into the mold cavity.

12. In the machine defined in claim 11, the passage being located in the base of the mold cavity opposite the side closed by the band means.

13. In the machine defined in claim 12, the heat transfer fluid introducing means including means for introducing heat transfer fluid under pressure through the passage in the segment of the casting wheel engaged by the band means second portion.

14. In the machine defined in claim 13, means for cutting off the supply of heat transfer fluid through the passage in a segment of the casting wheel which segment is free from engagement by the band means.

15. In the machine defined in claim 14, the heat transfer fluid introducing means including a distributor valve having a component rotated with the casting wheel.

16. In the machine defined in claim 15, the heat transfer fluid introducing means including a plurality of heat transfer fluid supply conduits connected to the distributor valve rotated component and extending therefrom to the casting wheel.

17. In the machine defined in claim 16, arm means connected directly between the valve rotated component and the casting wheel to assure synchronous rotation thereof without subjecting the heat transfer supply conduits to substantial mechanical stress.

18. In the machine defined in claim 16, the casting wheel including a radial mounting flange and a separate peripheral ring mold having the mold cavity, and drive means connected to said mounting flange, the heat transfer fluid supply conduits being routed so as not to interfere with slippage of said ring mold relative to said mounting flange.

19. In the machine defined in claim 16, each of the heat transfer fluid supply conduits extending to a different segment of the casting wheel.

20. In the machine defined in claim 19, the heat transfer fluid supply conduits being spaced equiangularly of the rotated valve component.

21. In the machine defined in claim 11, the heat transfer fluid introducing means including a plurality of separate heat transfer fluid supply conduits each connected to a different segment of the casting wheel, remote control valve means for controlling the supply of heat transfer fluid through said separate heat transfer fluid supply conduits, respectively, and means for controlling said valve means to supply heat transfer fluid during a predetermined segment of rotation of the casting wheel.

22. In a continuous casting machine having a rotatable casting wheel with a peripheral groove forming a continuous outward-opening mold cavity, band means for closing a segment of such mold cavity, such band means including a first portion approaching the casting wheel to a point of engagement therewith, a second portion extending from said first portion and looped around the casting wheel, such elongated second portion having its width extending across, overlying and closing the mold cavity, and a third portion extending from said second portion and departing from the casting wheel, means for introducing molten metal into the casting wheel peripheral groove adjacent to the point of engagement of the band means first portion with the casting wheel for solidification thereof during rotation of the casting wheel through the segment closed by the band means second portion and means for cooling the casting wheel in such segment closed by the band means second portion for extraction of heat to promote solidification of the metal, the improvement comprising a central portion and substantially the entire width of the band means second portion which overlies the mold cavity being formed at least partially of heat-insulative sheet material to deter heat transfer through such band means second portion.

23. In a continuous casting machine having a rotatable casting wheel with a peripheral groove forming a continuous outward-opening mold cavity, band means for closing a segment of such mold cavity, such band means including a first portion approaching the casting wheel to a point of engagement therewith, a second portion extending from said first portion, looped around the casting wheel and closing the mold cavity, and a third portion extending from said second portion and departing from the casting wheel, means for introducing molten metal into the casting wheel peripheral groove adjacent to the point of engagement of the band means first portion with the casting wheel for solidification thereof during rotation of the casting wheel through the segment closed by the band means and means for cooling the casting wheel in such segment closed by the band means for extraction of heat to promote solidification of the metal, the improvement comprising the casting wheel having a through passage opening into the mold cavity, and means for introducing heat transfer fluid under pressure through such passage into the mold cavity.

24. In the machine defined in claim 23, the passage being located in the base of the mold cavity opposite the side closed by the band means.

25. In the machine defined in claim 23, the heat transfer fluid introducing means including means for introducing heat transfer fluid under pressure through the passage in the segment of casting wheel closed by the band means second portion and means for cutting off the supply of heat transfer fluid through the passage in a different segment of the casting wheel which different segment is free from engagement by the band means.

26. In the machine defined in claim 23, the casting wheel having several circumferentially spaced through passages each located in the base of the mold cavity opposite the side closed by the band means, and including a porous insert fitted in each of such passages and having an outer end portion flush with the base of the mold cavity.

27. In the machine defined in claim 23, the casting wheel having several through passages opening into the base of the mold cavity and spaced circumferentially of the casting wheel, each of said passages being a round aperture.

28. In the machine defined in claim 23, the casting wheel having several through passages opening into the base of the mold cavity and spaced circumferentially of the casting wheel, each of said passages being in the form of a narrow groove elongated circumferentially of the casting wheel.

29. In the machine defined in claim 25, the heat transfer fluid introducing means including a distributor valve having a component rotated with the casting wheel.

30. In the machine defined in claim 29, the heat transfer fluid introducing means including a plurality of heat transfer fluid supply conduits connected to the distributor valve rotated component and extending therefrom to the casting wheel.

31. In the machine defined in claim 30, arm means connected directly between the valve rotated component and the casting wheel to assure synchronous rotation thereof without subjecting the heat transfer supply conduits to substantial mechanical stress.

32. In the machine defined in claim 30, the casting wheel including a radial mounting flange and a separate peripheral ring mold having the mold cavity, and drive means connected to said mounting flange, the heat transfer fluid supply conduits being routed so as not to interfere with slippage of said ring mold relative to said mounting flange.

33. In the machine defined in claim 30, each of the heat transfer fluid supply conduits extending to a different segment of the casting wheel.

34. In the machine defined in claim 33, the heat transfer fluid supply conduits being spaced equiangularly of the rotated valve component.

35. In the machine defined in claim 29, the heat transfer fluid introducing means including a plurality of separate heat transfer fluid supply conduits each connected to a different segment of the casting wheel, remote control valve means for controlling the supply of heat transfer fluid through said separate heat transfer fluid supply conduits, respectively, and means for controlling said valve means to supply heat transfer fluid during a predetermined segment of rotation of the casting wheel.

36. In the method of solidifying metal in a continuous casting machine having a rotatable casting wheel with a peripheral groove forming a continuous outward-opening mold cavity, band means for closing a segment of such mold cavity, such band means including a first portion approaching the casting wheel to a point of engagement therewith, an elongated second portion extending from said first portion and looped around the casting wheel, such elongated second portion having its width extending across, overlying and closing the mold cavity and a third portion extending from said second portion and departing from the casting wheel, mechanism for introducing molten metal into the casting wheel peripheral groove adjacent to the point of engagement of the band means first portion with the casting wheel for solidification thereof during rotation of the casting wheel through the segment closed by the band means second portion and means for cooling the casting wheel in such segment closed by the band means second portion for extraction of heat to promote solidification of the metal, the improvement which comprises deterring heat transfer from the metal through a substantial portion of the length of the second portion of the band means and throughout a central portion and substantially the entire width of the band means second portion which overlies the mold cavity while cooling the casting wheel without direct cooling of the band means to induce solidification of the metal in the area adjacent to the portion of the casting wheel being cooled more than adjacent to such substantial portion of the length of the band means second portion so that the metal solidifies in a direction generally radially outward with respect to the casting wheel.

37. In the method defined in claim 36, the improvement which further comprises deterring heat transfer through the second portion of the band means by insulating the central portion and substantially the entire width of the band means second portion which overlies the mold cavity.

38. In the method defined in claim 36, the improvement which further comprises deterring heat transfer from the metal through the central portion and substantially the entire width of the band means second portion which overlies the mold cavity for the major portion of the length of the second portion of the band means.

39. In the method defined in claim 36, the improvement which further comprises deterring heat transfer from the metal through the central portion and substantially the entire width of the band means second portion which overlies the mold cavity for substantially the entire length of the second portion of the band means.

40. In the method of solidifying metal in a continuous casting machine having a rotatable casting wheel with a peripheral groove forming a continuous outward-opening mold cavity, band means for closing a segment of such mold cavity, such band means including a first portion approaching the casting wheel to a point of engagement therewith, a second portion extending from said first portion, looped around the casting wheel and closing the mold cavity and a third portion extending from said second portion and departing from the casting wheel, means for introducing molten metal into the casting wheel peripheral groove adjacent to the point of engagement of the band means first portion with the casting wheel for solidification thereof during rotation of the casting wheel through the segment closed by the band means second portion and means for cooling the casting wheel in such segment closed by the band means second portion for extraction of heat to promote solidification of the metal, the improvement which comprises introducing heat transfer fluid under pressure into the mold cavity through a passage through the casting wheel during its segment of rotation closed by the band means second portion to promote heat extraction in such portion.

41. In the method defined in claim 40, the improvement which further comprises introducing the heat transfer fluid through the base of the mold cavity.

42. In the method defined in claim 40, the improvement which further comprises deterring heat transfer through the band means second portion so as to promote solidification of the metal in a direction radially outward with respect to the casting wheel.

43. In a continuous casting machine having a first movable mold component forming an elongated, continuous, outward-opening mold cavity, a second movable mold component including means for closing such mold cavity for a predetermined portion of its length, means for introducing molten metal into the mold cavity for solidification during movement with the first mold component through the portion closed by the second mold component and means for cooling one of the mold components adjacent to such closed portion of the mold cavity for extraction of heat to promote solidification of the metal, the improvement comprising means for deterring heat transfer from the metal to the other mold component for a central portion of the width, substantially the entire width and a substantial portion of the length of the closed portion of the mold cavity so as to induce solidification of the metal in the area adjacent to the cooled mold component more than adjacent to such other mold component so that the metal solidifies in a direction from the cooled mold component toward such other mold component more than would occur if heat transfer were promoted equally around the entire circumference of the metal in the mold cavity.

44. In the machine defined in claim 33, the deterring means deterring heat transfer from the metal to the other mold component for the central portion of the width, substantially the entire width and the major portion of the length of the closed portion of the mold cavity.

45. In the machine defined in claim 33, the deterring means deterring heat transfer from the metal to the other mold component for the central portion of the width, substantially the entire width and substantially the entire length of the closed portion of the mold cavity.

46. In the machine defined in claim 45, the deterring means including a solid layer of heat-insulative material secured to the other mold component and of a width sufficient and positioned to cover the central portion and substantially the entire width of the mold cavity.

47. In a continuous casting machine having a first movable mold component forming an elongated, continuous, outward-opening mold cavity, a second movable mold component including means for closing such mold cavity for a predetermined portion of its length, and means for solidification during movement with the first mold component through the portion closed by the second mold component, the improvement comprising one of the mold components having through passages opening into the mold cavity and means faor introducing heat transfer fluid under pressure through such passages into the mold cavity to promote solidification of the metal by extraction of heat assisted by such heat transfer fluid.

48. In the method of solidifying metal in a continuous casting machine having a first movable mold component forming an elongated, continuous, outward-opening mold cavity, a second movable mold component including means for closing such mold cavity for a predetermined portion of its length, means for introducing molten metal into the mold cavity for solidification during movement with the first mold component through the portion closed by the second mold component and means for cooling one of the mold components adjacent to such closed portion of the mold cavity for extraction of heat to promote solidification of the metal, the improvement which comprises deterring heat transfer from the metal through the other mold component for a central portion of the width, substantially the entire width and a substantial portion of the length of the closed portion of the mold cavity to induce solidification of the metal in the area adjacent to the cooled mold component more than adjacent to such other mold component so that the metal solidifies in a direction from the cooled mold component toward such other mold component more than would occur if heat transfer were promoted uniformly around the circumference of the metal in the mold cavity.

49. In the method defined in claim 48, the improvement which further comprises deterring heat transfer from the metal through the other mold component for the central portion of the width, substantially the entire width and the major portion of the length of the closed portion of the mold cavity.

50. In the method defined in claim 48, the improvement which further comprises deterring heat transfer from the metal through the other mold component for the central portion of the width substantially the entire width and substantially the entire length of the closed portion of the mold cavity.

51. In the method defined in claim 50, the improvement which further comprises deterring heat transfer from the metal through such other mold component by insulating such other mold component with a layer of insulative sheet material overlying the central portion and substantially the entire width of the mold cavity.

* * * * *

UNITED STATES PATENT AND TRADEMARK OFFICE

CERTIFICATE OF CORRECTION

PATENT NO. : 4,957,155

DATED : September 18, 1990

INVENTOR(S) : Zdenek Trnka

It is certified that error appears in the above-identified patent and that said Letters Patent is hereby corrected as shown below:

Claim 44: column 15, line 57, cancel "33" and insert --43--.

Claim 45: column 15, line 63, cancel "33" and insert --43--.

Claim 47: column 16, line 14, after "for" insert --introducing molten metal into the mold cavity for--;
column 16, line 18, cancel "faor" and insert --for--.

Signed and Sealed this

Fourteenth Day of January, 1992

*Attest:*

HARRY F. MANBECK, JR.

*Attesting Officer*

*Commissioner of Patents and Trademarks*